US009812273B2

(12) United States Patent
Breich et al.

(10) Patent No.: US 9,812,273 B2
(45) Date of Patent: Nov. 7, 2017

(54) COMMAND SELECTOR WITH ROTARY SCROLL WHEEL

(71) Applicant: DELPHI TECHNOLOGIES, INC., Troy, MI (US)

(72) Inventors: Pascal Breich, Altorf (FR); Emmanuel Cordier, Grendelbruch (FR); Claude Simon, Plobsheim (FR); Nicholas Tual, Strasbourg (FR)

(73) Assignee: Delphi Technologies, Inc., Troy, MI (US)

( * ) Notice: Subject to any disclaimer, the term of this patent is extended or adjusted under 35 U.S.C. 154(b) by 303 days.

(21) Appl. No.: 14/388,326

(22) PCT Filed: Mar. 14, 2013

(86) PCT No.: PCT/EP2013/055216

§ 371 (c)(1),
(2) Date: Sep. 26, 2014

(87) PCT Pub. No.: WO2013/143861

PCT Pub. Date: Oct. 3, 2013

(65) Prior Publication Data

US 2015/0034463 A1 Feb. 5, 2015

(30) Foreign Application Priority Data

Mar. 27, 2012 (FR) ..... 12 52748

(51) Int. Cl.
*H01H 9/00* (2006.01)
*H01H 19/00* (2006.01)
(Continued)

(52) U.S. Cl.
CPC ..... *H01H 19/003* (2013.01); *G05G 1/08* (2013.01); *H01H 19/025* (2013.01);
(Continued)

(58) Field of Classification Search
USPC ..... 200/17 R; 345/163
See application file for complete search history.

(56) References Cited

U.S. PATENT DOCUMENTS

2004/0150621 A1 8/2004 Bohn
2005/0110759 A1* 5/2005 Koo ..... G06F 3/0312 345/163

FOREIGN PATENT DOCUMENTS

DE 102007038580 A1 2/2009
EP 1 221 403 A2 7/2002

OTHER PUBLICATIONS

International Search Report dated Sep. 24, 2013.

* cited by examiner

*Primary Examiner* — Vanessa Girardi
(74) *Attorney, Agent, or Firm* — Lawrence D. Hazelton

(57) ABSTRACT

A command selector includes a scroll wheel mounted in a support and free to rotate about a main axis, a fixed printed circuit board, a detection wheel rotating about a secondary axis, a means of transmission rotationally connecting the scroll wheel to the detection wheel of which the rotations are detected by a rotation sensor arranged on the printed circuit board. The main axis and the secondary axis are non-parallel, the means of transmission defines an angle, and the detection wheel rotating in a plane parallel to the printed circuit board, the secondary axis being perpendicular to the printed circuit board, so as to minimize the circumscribed volume of the selector.

9 Claims, 2 Drawing Sheets

(51) Int. Cl.

| | |
|---|---|
| ***G05G 1/08*** | (2006.01) |
| ***H01H 25/00*** | (2006.01) |
| ***H01H 19/02*** | (2006.01) |

(52) U.S. Cl.
CPC ..... *H01H 25/008* (2013.01); *H01H 2231/026* (2013.01); *H01H 2231/052* (2013.01)

COMMAND SELECTOR WITH ROTARY SCROLL WHEEL

CROSS-REFERENCE TO RELATED APPLICATION

This application claims the benefit under 35 U.S.C. §371 of published PCT Patent Application Number PCT/EP 2013055216, filed Mar. 14, 2013, claiming priority to French patent application number FR1252748 filed on Mar. 27, 2012, and published as WO2013143861 on Oct. 3, 2013, the entire contents of which is hereby incorporated by reference herein.

TECHNICAL FIELD OF INVENTION

The present invention relates to a selector with easy-to-operate rotary scroll wheel designed to select a command.

BACKGROUND OF INVENTION

The multiplicity of commands and the diversity of means accessible to a vehicle driver have increased to the point that many vehicles have on their steering wheel, or on an offset satellite, one or more rotary scroll wheels which can be operated by a touch of the driver's thumb. These scroll wheels connected to displays or screens make it possible to scroll through the options of a menu of commands such as radio stations or names in an address book. In order to confirm a choice, the user must press the scroll wheel and push it in slightly like a conventional pushbutton.

From DE102007038580A1 is known a command selector of this type of which the rotary scroll wheel entrains a spur gear train and a disc with deep indentations, the rotation of which is detected by an optical sensor. The scroll wheel is further arranged in a support, and pressing on the scroll wheel displaces the scroll wheel and the support which actuates a switch of a printed circuit board. In a conventional manner, the switch is integrated in an elastomeric dome of a cover covering the printed circuit board.

The functionalities exist and the requirements now relate to the compactness of the device, the availability of commands and the tactile feel experienced by the user. It becomes important to propose compact selectors capable of being accommodated in spaces which are not only restricted, but also difficult to fit because they have convex or inclined surfaces. Furthermore, pushbuttons or displays or even other rotary selectors must be able to be placed in the vicinity thereof.

SUMMARY OF THE INVENTION

The proposed invention solves the problems mentioned by proposing a compact command selector comprising a scroll wheel mounted in a support, the scroll wheel being free to rotate about a main axis. The selector further comprises a fixed printed circuit board, a detection wheel rotating about a secondary axis and a means of transmission rotationally connecting the scroll wheel to the detection wheel. The rotations of the scroll wheel are thus detected by a rotation sensor arranged on the printed circuit board. The main axis and the secondary axis are non-parallel, convergent or non-convergent, the means of transmission therefore comprising an angle so that the detection wheel rotates in a plane parallel to the printed circuit board. The secondary axis is perpendicular to the printed circuit board, so as to advantageously minimize the circumscribed volume of the selector.

More particularly, the main axis and the secondary axis are convergent and form a right angle, the angle of the means of transmission being 90°.

Furthermore, the means of transmission is a gear train of which the driving gear is integrally connected to the scroll wheel by a driving shaft extending and rotating on the main axis. The diameter of the driving gear is advantageously smaller than that of the scroll wheel so that a style front can cover the gear train without interfering with it. The style front is moreover provided with an opening from which emerges a portion of the scroll wheel. One possibility is that the driving gear is conical and part of a bevel gear mechanism transmitting the rotations of the scroll wheel to a driven shaft which extends in the direction of the printed circuit board along the secondary axis, the detection wheel being fixed to the driven shaft.

In a first embodiment, the driving bevel gear is advantageously arranged as close as possible to the scroll wheel, between the scroll wheel and the apex of the pitch cone of the bevel gear mechanism, which is the intersection of the main axis and the secondary axis, so as thus to minimize the overall length of the selector, which length is measured along the main axis.

In a second embodiment, the driving bevel gear is arranged at a distance from the scroll wheel at the end of the driving shaft, the apex of the pitch cone of the bevel gear mechanism then being between the scroll wheel and the driving gear. Thus, as close as possible to the scroll wheel is provided a space capable of receiving a device such as a backlit display arranged between the style front and the driving shaft.

In a third embodiment, the driving gear has spur teeth thus forming, with a first driven gear, a first spur gear mechanism with axes parallel to the main axis. The first driven gear further has a tooth width greater than the width of its root cylinder so that its teeth project parallel to the main axis. The projecting portion meshes with the teeth of a second driven gear which for its part rotates about the secondary axis so as thus to form the angle of the gear train. The detection wheel is axially fixed to the second driven gear.

Furthermore, pressing on the scroll wheel causes it to perform a translational movement along the secondary axis, the translational movement of the scroll wheel also displacing the support along the secondary axis, moving it closer to the printed circuit board. Thus a position sensor arranged on the printed circuit board is actuated. The selector is further provided with an elastic means exerting on the support a return force opposed to the translational movement of the support. Thus, without any handling, the scroll wheel and its support remain in a neutral position remote from the printed circuit board. The elastic means may in particular be an elastomeric dome forming part of a cover which covers the printed circuit board, the dome integrating a component of the position sensor.

During the translational movements along the secondary axis of the scroll wheel performed according to the third embodiment, the projecting teeth of the first driven gear engaging with the second driven gear slide along the secondary axis between the teeth of the second driven gear. The second driven gear which carries the detection wheel then remains immobile during the translational movements of the scroll wheel.

The detection wheel comprises at least one radial arm forming an angular area, but more often two in the form of a bow tie, and the rotation sensor comprises two optical transmitter-receivers detecting passage of the radial arm in their location, thus making it possible to determine the direction of rotation of the scroll wheel.

The selector may further comprise a backlit device. The device comprises a light source, typically one or more light-emitting diodes, arranged on the printed circuit board and emitting a light beam conducted by a light guide as far as a display which is distant from the printed circuit board, which is itself arranged close to the scroll wheel. The light guide forms a portico which bypasses the means of transmission. The invention also relates to a control module comprising a command selector executed according to the above paragraphs. The selector is arranged in a housing provided with a style front substantially perpendicular to the secondary axis. The front is provided with at least one opening from which emerges a cylindrical portion of the scroll wheel of the selector so as to be able to operate the scroll wheel. The housing is provided with female or male linear guides oriented along the secondary axis, which cooperate with male or female guides respectively, provided in the support of the scroll wheel. When pressure is applied to the scroll wheel, the support slides in the guides and does not tilt. Furthermore, a button which can be operated may be arranged on the style front close to the scroll wheel.

The invention lastly relates to a control interface of a device such as a vehicle steering wheel, a dashboard or motorcycle handlebars, the device being provided with a module as described above.

BRIEF DESCRIPTION OF DRAWINGS

Other characteristics, objects and advantages of the invention will be apparent on reading the detailed description below and on looking at the attached drawings, given by way of example without limitation, in which.

DETAILED DESCRIPTION

Figure 1:
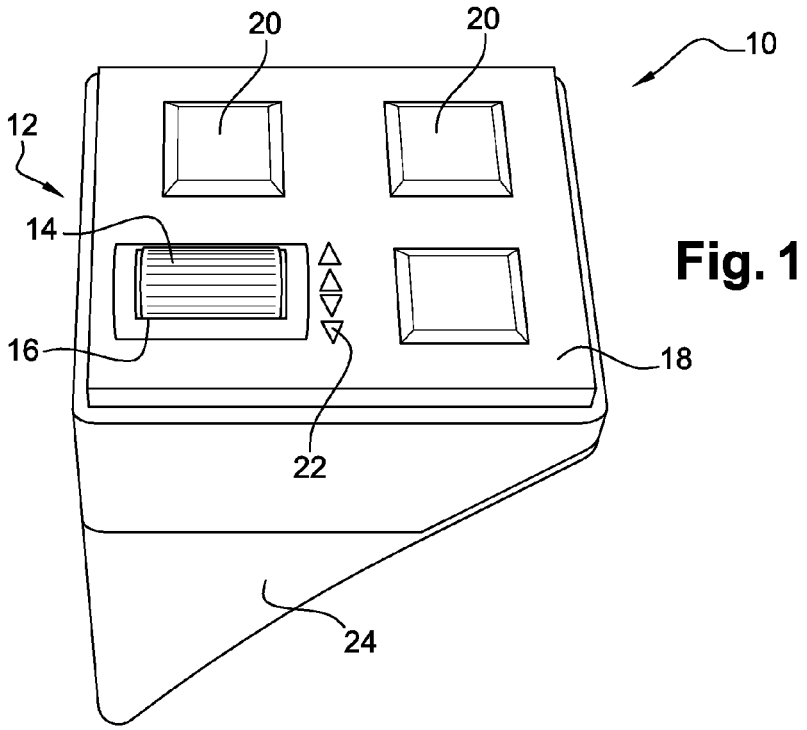
FIG. 1 is an isometric view of a control module in which is arranged a command selector according to the invention.

In FIG. 1 is shown a control module 10 comprising a selector 12 with rotary scroll wheel. The scroll wheel 14, which appears only partly through an opening 16 formed in a style front 18, can be rotated by simply touching it with the thumb so as to select a command presented on a drop-down menu on a display or screen (not shown). It may for example be a matter of choosing a radio station from among those preselected and placed in the memory, or the name of a correspondent in an address book. Rotation of the scroll wheel 14 causes the stations or names to be scrolled through one by one. The scroll wheel 14 further makes it possible to confirm the selection by pressing on the scroll wheel 14 perpendicularly to the style front 18. The pressure pushes the scroll wheel 14 down slightly in the manner of a scroll wheel of certain computer mice. In the vicinity of the scroll wheel 14 are arranged pushbuttons 20 which actuate other commands and in the immediate vicinity of the scroll wheel 14 is placed a backlit display 22.

The whole is located in a reference comprising a main axis A1, which is the axis of rotation of the scroll wheel 14, and a secondary axis A2 perpendicular to the main axis A1, which is the axis along which the scroll wheel 14 can be pushed in. The style front 18 is substantially perpendicular to the secondary axis A2.

Such a module may be fitted to a vehicle steering wheel or motorcycle handlebars, but can also be installed on a satellite peripheral to the steering wheel of a vehicle and combining several controls under the steering wheel, or even on the dashboard of any vehicle or machine, or even be added to the already numerous devices of a computer keyboard or video games joystick.

The module 10 comprises a housing 24 having a bottom, four side faces and a cover defining an internal volume in which is arranged the selector with scroll wheel 12. The cover can be the style front 18 itself, which is visible to the user and provided with the opening 16 through which the scroll wheel 14 can be operated. In the example of FIG. 1 the bottom of the housing is steeply inclined relative to the style front 18, taking into account the cramped space which receives the module 10. The form shown is only an illustration, and other forms of housing 24 are of course possible.

Figure 2:
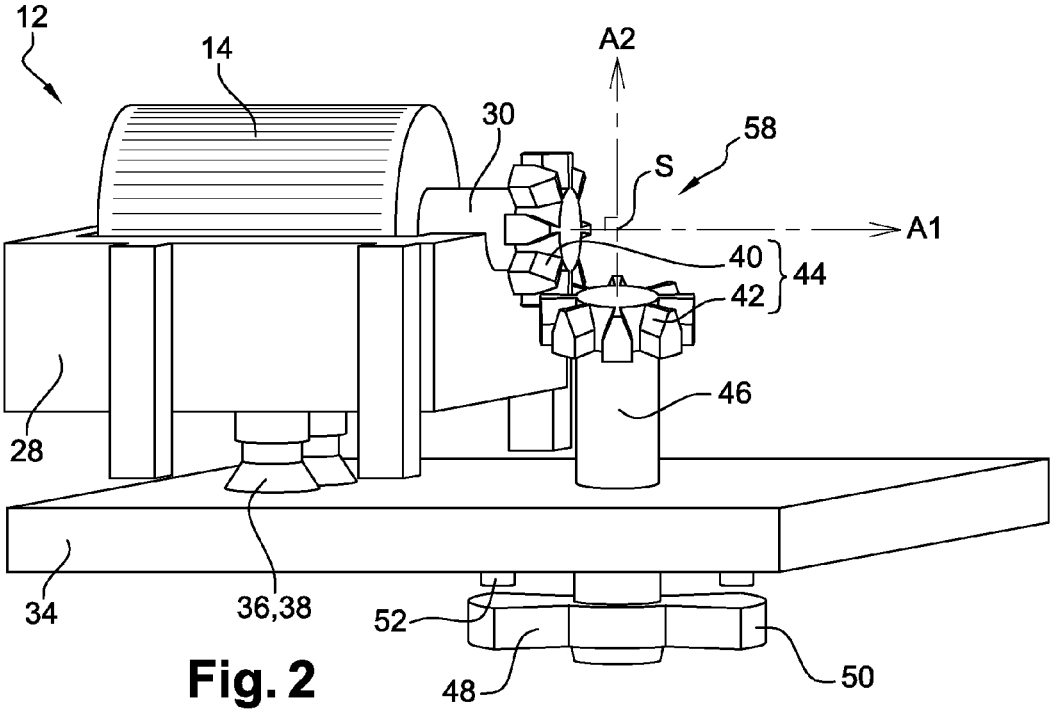
FIG. 2 is a perspective view which shows a first embodiment of the command selector of FIG. 1.

A first embodiment of the selector 12 is shown in FIG. 2. The scroll wheel 40 has a cylindrical or other shape, for example slightly domed. It is arranged on the main axis A1 and it is mounted in a bathtub-like support 30. A driving shaft 30 axially fixed to the scroll wheel 14 extends along the main axis A1 on either side of the scroll wheel 14 so as to cooperate with two circular openings provided in the support 30 thus forming two bearings. The support 30 is arranged on a printed circuit board 34 fixed in the housing 24 parallel to the style front 18. The printed circuit board 34 comprises position sensors 36, or switches, placed under elastomeric domes 38 forming part of a wider cover which covers the printed circuit board 34. An electrically conductive chip is integral with the interior of the domes 38 so as to close a control circuit when pressure is applied to the dome.

Furthermore, at one end of the driving shaft 30 is mounted a driving bevel gear 40 meshing at right angles with a driven bevel gear 42 forming a first gear mechanism 44 with a ratio of 1, the two gears 40, 42 having the same number of teeth. The driving gear 40, which is coaxial with the scroll wheel 14, has a head diameter smaller than the diameter of the scroll wheel 14 so that the style front 18 can cover the driving gear 40 without it being necessary to adjust the bushing, as the scroll wheel 14 for its part projects through the opening 16.

A driven shaft 46 extending in the direction of the printed circuit board 34 along the secondary axis A2 is axially fixed to the driven gear 42. At the end of the driven shaft 46 is fixed a detection wheel 48 parallel to the printed circuit board 34. The detection wheel 48 is provided with two angular areas 50 extending radially from the centre of the wheel 48, and the printed circuit board 34 for its part is provided with two optical sensors 52 of the transmitter-receiver type arranged on either side of the secondary axis A2 of rotation of the detection wheel 48, so that a signal emitted can be reflected by an angular area 50, then received by the optical sensor 52.

From the point of view of operation, rotation of the scroll wheel 14 on the main axis A1 entrains the bevel gear mechanism 44 so as to rotate the detection wheel 48 in a plane parallel to that of the printed circuit board 34. The optical sensors 52 detect the angular areas 50 of the detection wheel 48 successively passing their location, and when an angular area 50 is opposite a sensor 52, the optical signal emitted is reflected and the sensor 52 sends an electrical signal "1" to a control unit (not shown). When the angular area 50 is passed and the sensor 52 is located between the two angular areas 50, the signal emitted is not reflected and the sensor 52 sends the control unit an electrical signal "0". The two sensors 52 arranged in opposition in turn send signals "0" and "1", and the control unit interprets this information so as to determine the direction of rotation of the detection wheel 48, and hence the direction of rotation of the scroll wheel 14.

As each of the two sensors 52 can send a signal "0" or "1", and the wheel 48 is provided with two angular areas 50, the result is eight possible combinations of signals during one revolution of the detection wheel 48: 00, 10, 11, 01, 00, 10, 11, 01. The control unit determines the direction of rotation of the scroll wheel 14 as a function of the change of combination. For instance, if the combination changes from 01 to 00, the direction of rotation will be the opposite of the one corresponding to a change of combination from 01 to 11.

A device producing more or less than eight combinations per revolution is easy to achieve either by having a different number of angular areas, another number of transmitter-receivers, or even by having a first gear mechanism with a transmission ratio different to 1. Furthermore, FIG. 2 shows an arrangement of the sensors and detection wheel under the printed circuit board, "under" meaning between the board and the bottom of the housing, although an opposite arrangement above the printed circuit board is of course possible.

A gear ratio different to 1 is also possible, and similarly the gears of the gear mechanism can be very different, taking into account the profile or module of teeth.

With the object of improving the tactile feel during rotations of the scroll wheel 14, it is possible to attach to the selector 12 an indexing device (not shown). Such a device may for example comprise a toothed wheel driven in rotation by the scroll wheel 14 and cooperating with the free end of a flexible lamella fixed to the support 28 by its other end. The rotation of this toothed wheel and the jerky displacement of the lamella moving from one tooth to the next generates a small cyclic force which is perceived as pleasant by the operator. Structurally, the toothed wheel can be integral with the driving shaft, on any side of the scroll wheel 14 whatsoever, or integral with the driven shaft 46. The latter configuration makes it possible to arrange the lamella between the support 28 and the printed circuit board 34, for example parallel to the main axis A1, without modifying the envelope volume of the selector.

It is not imperative to add a toothed wheel, it is possible to use for the same purpose one of the gears of the gear train, the driving gear or the driven gear. Similarly, the lamella can be replaced by any known means such as an index system or a ball and a spring.

Still from the point of view of operation, pressing on the scroll wheel 14 along the secondary axis A2 displaces the scroll wheel 14 and the support 30 along the secondary axis A2 and causes the position sensor 36 to travel. The dome 38 is deformed and the travel causes the closure of an electrical circuit, thus confirming a command which has been selected during a previous rotation of the scroll wheel 14. The deformed dome 38 then exerts on the support a return force directed along the secondary axis A2 opposite the deformation, so that without any bias the scroll wheel 14 and the support 28 remain in a neutral position remote from the printed circuit board 34. The selector 12 can easily be designed so that the travel of the scroll wheel 14 is over a so-called "long" distance of approximately 2 mm or a so-called "short" distance of less than 1 mm. Confirmation of the commands may also be done by an action on another device, for example a nearby pushbutton, and then the scroll wheel has no option of translational movement and can only rotate about the main axis.

When pressure is applied to the scroll wheel 14, the gear train comprising the driving gear 40, the driven gear 42, the driven shaft 46 and the detection wheel 48 is moved translationally along the secondary axis A2 by the value of the distance of travel. Thus, the detection wheel 48 moves slightly away from the printed circuit board 34 and the optical sensors 52. This slight movement away does not affect the transmission or reception of a reflected signal at all. Symmetrically, in the case of a detection wheel 48 arranged on the front face of the printed circuit board 34, pressing on the scroll wheel 14 moves the detection wheel 48 closer to the printed circuit board 34. This movement towards the board must be provided so that the detection wheel does not come into contact with the printed circuit board, nor does this assembly affect operation of the optical sensors which continue to transmit and receive the reflected signals.

In FIG. 2 the bevel gear 44 creates an angle 58 at 90°, so that the detection wheel 48 rotates in a plane parallel to the printed circuit board 34. Other angles may be chosen according to the arrangement of the printed circuit board 34 in the housing 24, the desired aim being to minimise the envelope volume, or circumscribed volume, of the selector 12 and to be able to arrange other devices alongside the selector 12.

Figure 3:
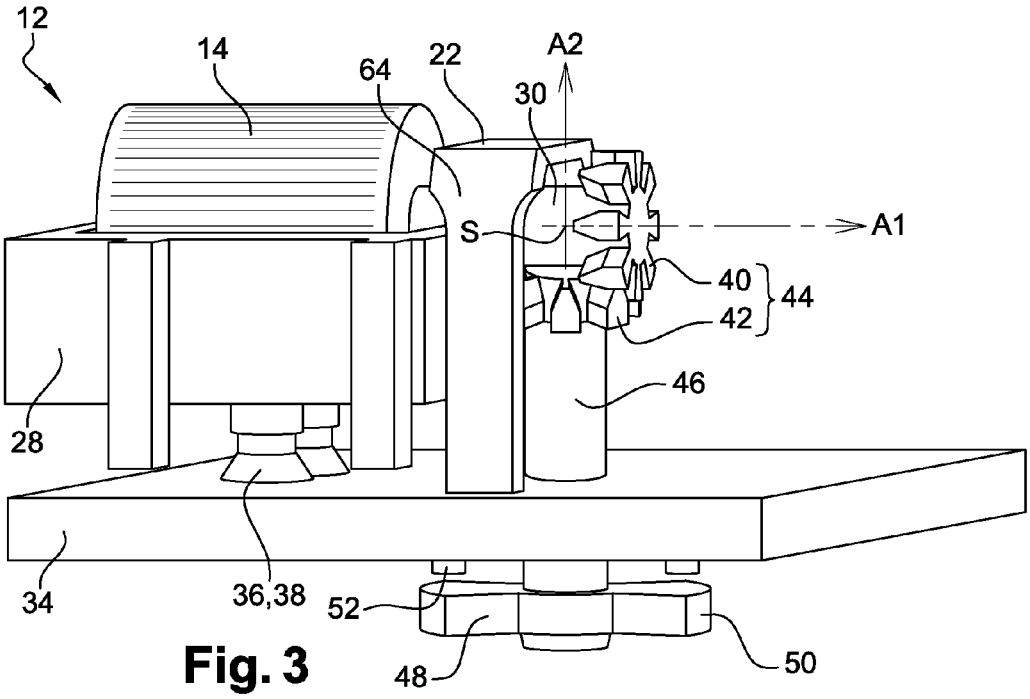
FIG. 3 is a view similar to that of FIG. 2 showing a second embodiment of the command selector of FIG. 1.

FIG. 3 shows a second embodiment of the selector 12 based on the principle of the first embodiment of FIG. 2. In this alternative the driving shaft 30 extends along the main axis A1 beyond the secondary axis A2. Thus the apex S of the pitch cone of the first gear mechanism 44, which is also the point of intersection of the main axis A1 and the secondary axis A2, is situated between the scroll wheel 14 and the driving gear 40. As the driving shaft 30 has a diameter smaller than that of the driving gear, this embodiment has the advantage of arranging in the immediate vicinity of the scroll wheel 14, between the driving shaft 30 and the style front 18, a space available for arranging a device such as the backlit display 22 there.

The display 22 comprises a light source, typically one or more light-emitting diodes, arranged on the printed circuit board 34, and a light guide 64 which conducts the light beam emitted from the source to the style front 18. The light guide 64 is in the form of a portico of which the two uprights extend from the printed circuit board 34 in the direction of the style front 18 and are connected by a crossbar. The light beam thus illuminates the crossbar so as to be partly visible to the user. As an illustration, in FIG. 1 the visible portions of the display 22 show arrows, but any other motif is of course possible.

Figure 4:
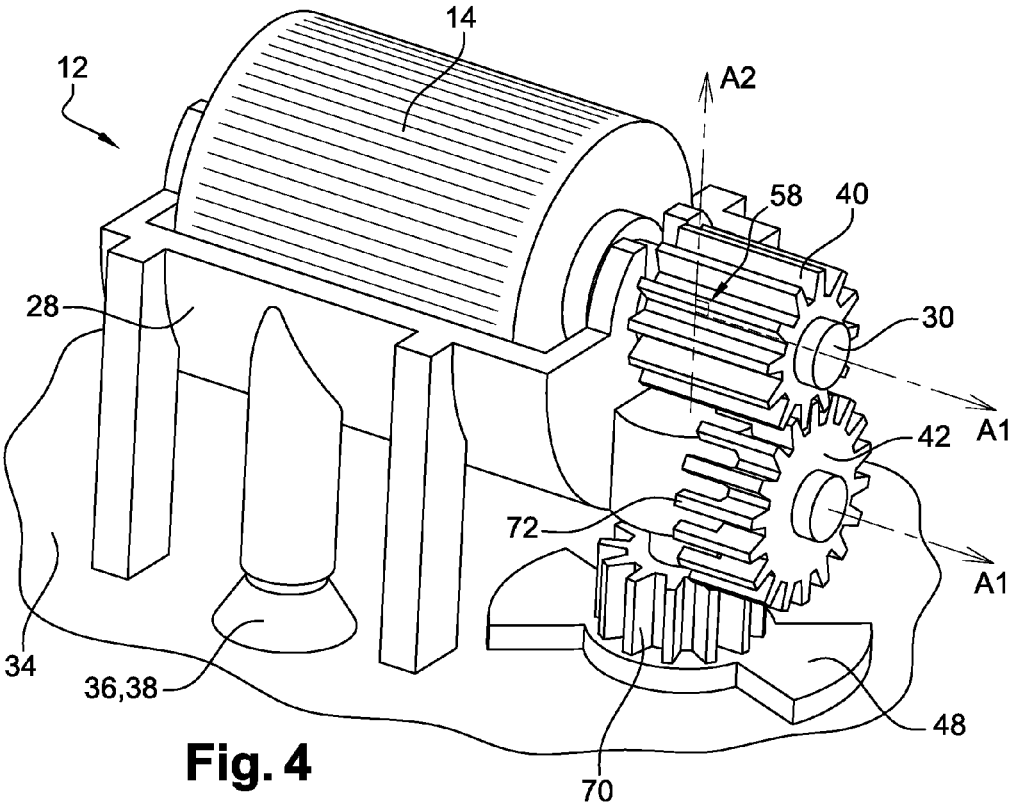
FIG. 4 is a view similar to that of FIG. 2 showing a third embodiment of the command selector of FIG. 1.

FIG. 4 shows a third embodiment of the selector 12. The gear train of this third embodiment comprises three gears with spur teeth. The axes of the driving gear 40 and of the first driven gear 42 are parallel and oriented along the main axis A1, while the axis of the second driven gear 70, which is integral with the detection wheel 48, is along the secondary axis A2. To form the angle 58 at 90°, the teeth of the first driven gear 42 are longer than the base cylinder of this gear is wide, and the teeth therefore project 72 in the direction of the second driven gear 70, so as to mesh with it. The rotations of the scroll wheel 14 are thus transmitted to the detection wheel 48 rotating about the secondary axis A2. When pressure is applied to the scroll wheel 14, the projecting teeth 72 slide in the teeth of the second driven gear 70 without displacing it.

In a fourth alternative, not shown, the gear train can be replaced by a flexible link such as a belt or an elastic band and pulleys arranged so as to transmit the rotation of the scroll wheel to the detection wheel, while allowing the translational movement of the scroll wheel along the secondary axis.

The invention claimed is:

1. A command selector comprising:

a scroll wheel mounted in a support and free to rotate about a main axis;

a detection wheel configured to rotate about a secondary axis;

a gear train rotationally connecting the scroll wheel to the detection wheel; and a fixed printed circuit board provided with a sensor configured to detect rotations of the detection wheel, wherein the main axis and the secondary axis are non-parallel, the gear train defines an angle, and the detection wheel is configured to rotate in a plane parallel to the printed circuit board, such that the secondary axis is perpendicular to the printed circuit board, wherein the scroll wheel is operable to perform a translational movement along the secondary axis, wherein the translational movement of the scroll wheel displaces the support along the secondary axis thereby moving it closer to the printed circuit board so as to actuate a position sensor arranged on the printed circuit board, the selector being further provided with an elastic means exerting on the support a return force opposed to the translational movement of the support so that, without any handling, the scroll wheel and its support remain in a neutral position remote from the printed circuit board, wherein the elastic means is an elastomeric dome forming part of a cover which covers the printed circuit board, the dome integrating a component of the position sensor.

2. The selector according to claim 1, wherein the main axis and the secondary axis are convergent and form a right angle, whereby the angle of the gear train is 90°.

3. The selector according to claim 1, wherein the selector includes a backlit device, the device comprising a light source arranged on the printed circuit board and emitting a light beam conducted by a light guide as far as a display which is distant from the printed circuit board and arranged close to the scroll wheel.

4. The selector in accordance with claim 1, wherein the selector is arranged in a housing provided with a style front substantially perpendicular to the secondary axis, the front configured to define an opening from which emerges a cylindrical portion of the scroll wheel of the selector so as to allow operation of the scroll wheel by a user, and thereby forms a control module.

5. The selector according to claim 1, wherein a driving gear of the gear train is integrally connected to the scroll wheel by a driving shaft extending and rotating on the main axis, the driving gear having a diameter smaller than that of the scroll wheel so that a style front provided with an opening from which emerges a portion of the scroll wheel can cover said gear train.

6. The selector according to claim 5, wherein the driving gear has spur teeth forming, in cooperation with a first driven gear, a first spur gear mechanism with axes parallel to the main axis, the first driven gear having a tooth width greater than the width of its root cylinder so that the spur teeth project parallel to the main axis, the projecting portion meshing with the teeth of a second driven gear that rotates about the secondary axis to form the angle of the gear train, the detection wheel being axially fixed to the second driven gear.

7. The selector according to claim 5, wherein the driving gear is conical and part of a bevel gear mechanism configured to communicate the rotations of the scroll wheel to a driven shaft which extends in the direction of the printed circuit board along the secondary axis, the detection wheel being fixed to the driven shaft.

8. The selector according to claim 7, wherein the driving gear is arranged as close as possible to the scroll wheel between the scroll wheel and the apex of the pitch cone of the bevel gear mechanism so as to minimise the overall length of the selector, wherein said length is measured along the main axis.

9. The selector according to claim 7, wherein the driving gear is arranged at a distance from the scroll wheel at the end of the driving shaft, the apex of the pitch cone of the bevel gear mechanism is situated between the scroll wheel and the driving gear so as thus to provide, as close as possible to the scroll wheel, a space capable of receiving a backlit display.

* * * * *